United States Patent [19]

Macauley

[11] 3,963,373

[45] June 15, 1976

[54] CONTOURED SHEET METAL AIRFOIL FANS

[75] Inventor: William T. Macauley, West Bloomfield, Mich.

[73] Assignee: Ford Motor Company, Dearborn, Mich.

[22] Filed: July 3, 1974

[21] Appl. No.: 485,645

[52] U.S. Cl. ..... 416/214 A; 416/208; 416/DIG. 3

[51] Int. Cl.[2] ..... F04D 29/34

[58] Field of Search ..... 416/208, 214, 214 A, 416/132 A, DIG. 3, 219 A; 29/156.8 B

[56] References Cited

UNITED STATES PATENTS

| | | | |
|---|---|---|---|
| 1,611,547 | 12/1926 | Miller | 416/214 A |
| 2,100,980 | 11/1937 | Schwartz | 416/214 |
| 2,581,872 | 1/1952 | Morrison | 416/214 |
| 2,802,619 | 8/1957 | Clarke | 416/214 A |
| 2,866,616 | 12/1958 | Stalker | 416/214 A X |

FOREIGN PATENTS OR APPLICATIONS

| | | | |
|---|---|---|---|
| 42,539 | 6/1910 | Austria | 416/214 |
| 1,074,499 | 10/1954 | France | 416/244 |
| 861,734 | 1/1953 | Germany | 416/214 |
| 872,816 | 4/1953 | Germany | 416/208 |
| 614,074 | 1949 | United Kingdom | 416/214 |
| 492,801 | 9/1938 | United Kingdom | 416/213 |

*Primary Examiner*—Everette A. Powell, Jr.
*Attorney, Agent, or Firm*—Joseph W. Malleck; Keith L. Zerschling

[57] ABSTRACT

A fan blade and root assembly is disclosed for use in a hot gas engine requiring low weight and high efficiency. The root construction facilitates simple sheet metal stamping fabrication throughout the blade, root, and hub while permitting an air foil shape to be imported to the blade.

7 Claims, 12 Drawing Figures

CONTOURED SHEET METAL AIRFOIL FANS

BACKGROUND OF THE INVENTION

Hot gas engines of the Stirling type require a low temperature space as part of a closed gas system. The low temperature is achieved by way of a cooling system which typically employs a fan assembly for moving ambient air through a heat exchange or radiator unit. The operating demand placed upon a fan assembly for a reciprocating engine is not as severe as that for a hot gas engine where a greater flow of ambient air at higher velocities is necessary. At the same time, a hot gas engine of the Stirling type, must be extremely sensitive to undue weight increases. Accordingly, it is desirable that the weight of the fan assembly be minimized while at the same time insuring high efficiency. This is a difficult problem to overcome since the Stirling engine requires a larger radiator than the internal combustion engine; it is roughly estimated that a Stirling engine requires a radiator of about 2.5 times as large as that of an automotive engine for the same supplied horsepower. The fan requirements are multiplied accordingly.

To reduce weight and at the same time provide for ease of manufacture and higher efficiency, the prior art has attempted to stamp a plurality of fan blades from a common sheet of metal; the stamped sheet is assembled by fasteners to a heavy open-fingered type of hub. However, such method did not allow the fan blading to assume an air foil configuration but rather a flat configuration. The described standard method of blade to hub attachment limited the number of blades and degree of pitch angle that fan assemblies could accept. In the turbine wheel art, a similar approach with stamped sheet metal blading has been used; the blading was twisted at its neck into a predetermined air foil contour, but the twisting of the neck of several blades from a common hub flange created stress points which would not operate consistently over the intended life of the fan.

SUMMARY OF THE INVENTION

A primary object of this invention is to provide a fan assembly with the fan root and fan blade integrally stamped from a common sheet of metal and yet permitting highly contoured air foil shapes for the fan blading without sacrificing strength and durability.

SUMMARY OF THE DRAWINGS

FIG. 6 is a plan view of a blank similar to that of FIG. 1, FIG. 5 is a perspective view similar to that of FIG. 2, and FIG. 7 is a sectional view taken along a central line of the structure of FIG. 5;

FIG. 10 shows a top view of one root and blade assembly on a hub, FIG. 11 shows an elevational sectional view of the hub and blade assembly of FIG. 12, FIG. 12 shows, in perspective, at least one blade and root assembly stationed in a uniquely contoured hub construction;

DETAILED SPECIFICATION

Figure 1:
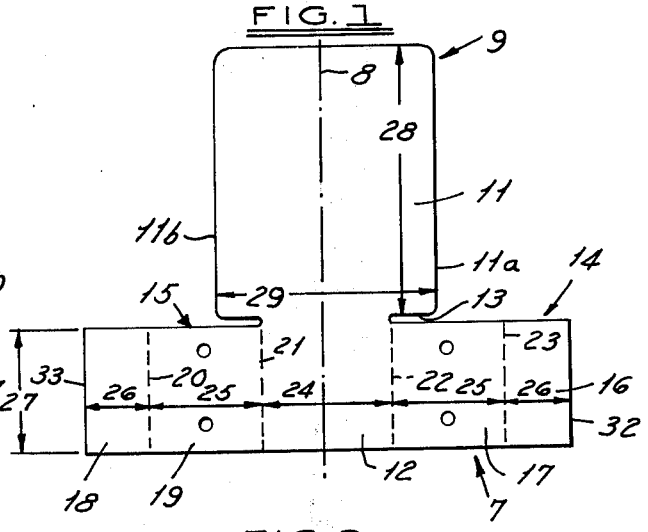
FIG. 1 is a plan view of a stamped blank prior to folding for purposes of defining a root and blade assembly for a fan useful in a Stirling type engine.

Turning now to the drawings and particularly to FIGS. 1–4, there is shown one embodiment of the present invention. A blade and root assembly is shown in the full line in FIG. 2 which is formed from a blank 9 defined from a single ply of sheet metal as shown in FIG. 1. The blank 9 has a blade periphery 11 defined with a longitudinal extent 28 and a transverse width 29; the blade has a generally rectangular plan configuration with leading edge 11*b* and trailing edge 11*a* arranged with respect to the blade axis 8. A root portion 7 of the blank extends from the blade periphery 11 along axis 8 and has web 12 intermediate the leading edge 11*b* and trailing edge 11*a* of the blade. The web has leading and trailing edges 21 and 22 respectively and to which is respectively connected wings 15 and 14. The wings are symmetrically arranged about axis 8. Wing portion 14 has a first portion 17 which is adapted to be folded with respect to a second portion 16 along a line 23. Similarly, wing 15 has a first portion 19 adapted to be folded with respect to a second portion 18 along line 20. The transverse width 24 of the web is at least ⅓ less than the transverse width 29 of the blade; the specific width 24 will vary depending on the material section needed to carry the experienced stress. Since the wings attached to the web will be bent out of the plane of the web during fabrication, the wings are spaced slightly from blade periphery 11 by slots 13. The transverse width of the wing portions (25 and 26) are arranged to define a polygon as will be described. The gauge of the blank 9 is preferably in the range of 0.060–0.080 inch.

Figure 2:
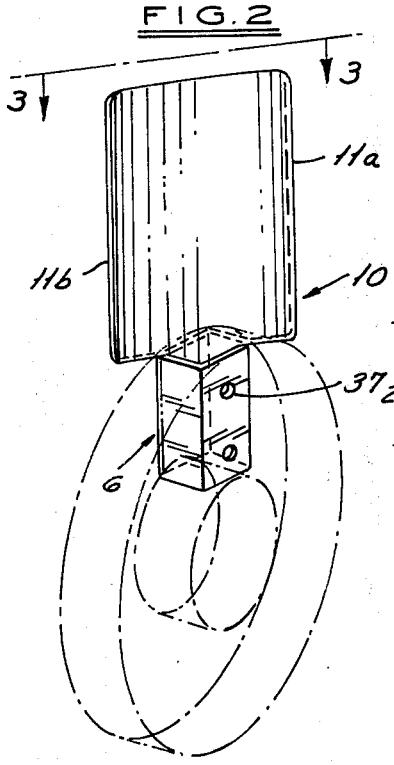
FIG. 2 is a perspective view showing the root and blade assembly contoured into a three dimensional effect; the figure further illustrates (in phantom outline) the hub to which the assembly is attached.
Figure 3:
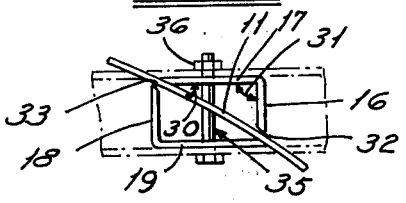
FIG. 3 is an end view taken along line 3—3 of FIG. 2.
Figure 4:
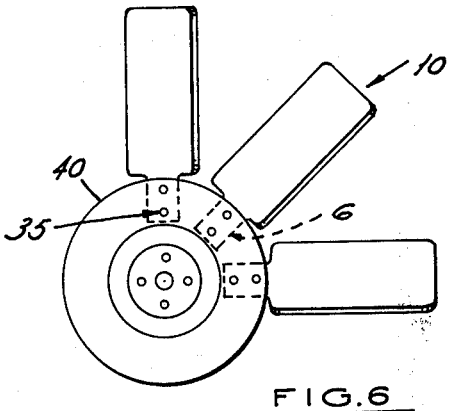
FIG. 4 is a side elevational view of several of the fan and root assemblies stationed on a common hub according to the embodiment of FIGS. 1 and 2.

The completed root assembly 6 and completed blade 10 is formed as shown in FIGS. 2–4. The blade periphery 11 is given an air foil shape by contouring the transverse width 29 along a predetermined curvilinear path, principally equivalent to NASA air foil shape by contouring the transverse width 29 along a predetermined curvilinear path, principally equivalent to NASA air foil configurations (see FIG. 3). The web 12 is retained in its flat configuration, but the wing portions are folded to form a root polygon 6 (see FIG. 2) whereby the first portions are symmetrically and oppositely bent along their juncture lines to make an included angle 30 at the web of about 30°–50°. The outermost portions 16 and 18 respectively are bent along the fold lines 23 and 20 with respect to the first portions so as to have their respective terminating edges 33 and 32 in contact or spaced slightly from web 12; an included angle 31 is formed which is about 90°. The formed wing portions thereby constitute a hollow polygonal shape having generally straight sides. Note that the full blade section is devoid of turbulizers such as result from prior art constructions overlapped plys of support and rivets; streamlined blade efficiency results.

In FIG. 4, each of the blade and root assemblies are mounted on a hub 40 which may preferably be formed from sheet metal and arranged to fit about the sides of the root assemblies permitting a securing means 35 to extend through the hub as well as the root assembly for preventing relative rotary movement therebetween. Openings 37 may be formed through the portions 19 and 17 and through the web for receiving a securing means 35 which may constitute a threaded fastener and mating nut 36.

Figure 5:
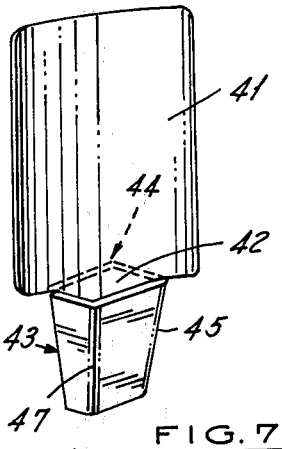
FIGS. 5–7 are a series of views similar to that of FIGS. 1–3 for another embodiment.
Figure 6:
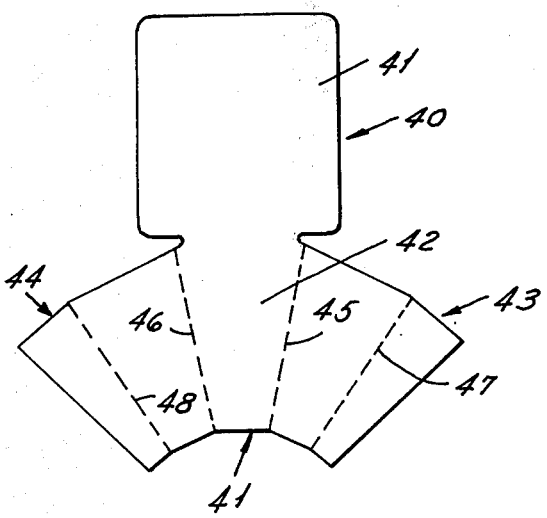
Figure 7:
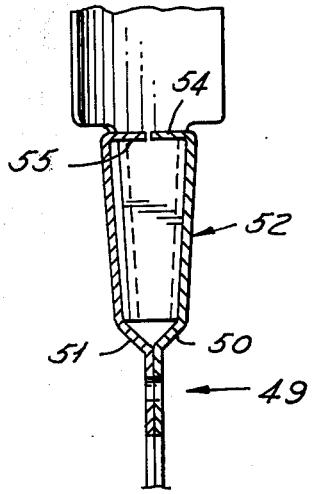

The blade and root assembly may be defined in a first modified manner as shown in FIGS. 5 through 7. The blank 40 (FIG. 6) has a contoured blade 41 (NASA air foil shape) and a root extension 41 comprised of a trapezoidal web 42 and trapezoidal wings 43 and 44 extending from opposite sides thereof. The trapezoids are arranged so that upon folding the wings along lines 45 through 48, a trapezoidal polygon will result as shown in FIG. 5.

The hub 49 is fabricated from two plys of sheet metal (50 and 51) with the plys in a center zone 51 joined together and separated in an outer zone 52 to form a hollow ring. The root assemblies are stationed about and in the hub ring with close circumferential spacing and nesting permitted therebetween due to the trapezoidal configuration. The inwardly directed flanges 54 and 55 mate with the air foil contour of the blade to lock it in place.

Figure 9:
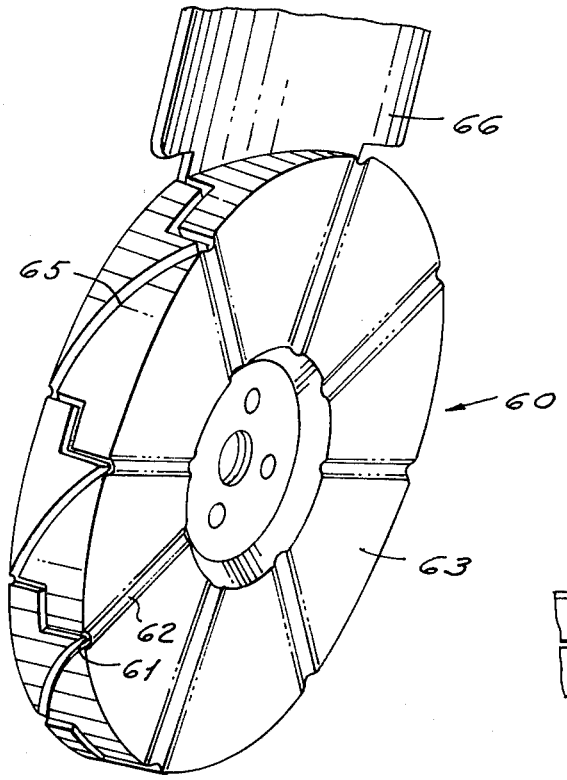
FIGS. 8 and 9 are views depicting still another embodiment, FIG. 8 showing a perspective view of a contoured sheet metal blade and root assembly and FIG. 9 showing the blade assembly positioned on a uniquely constructed hub for receiving said assembly.
Figure 8:
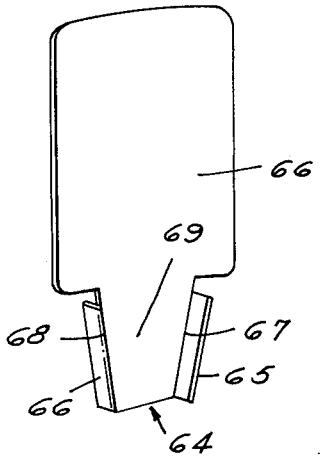

The embodiment illustrated in FIGS. 8 and 9 have hub 60 arranged with radially directed grooves 61 defined on the interior of ribs 62 disposed in the ring 63 thereof. Each root assembly 64 has tabs 65 and 66 arranged on the leading and trailing edges (67 and 68) of the trapezoidal web 69. The tabs interfit within the grooves 61 to lock the root assembly within the hub. Slots 65 are also formed in the outer periphery of ring 63 to receive the air foil shaped blade 66 and lock the blade in place.

Figure 10:
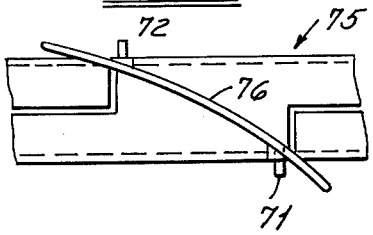
FIGS. 10–12 illustrate still another embodiment of this invention.
Figure 12:
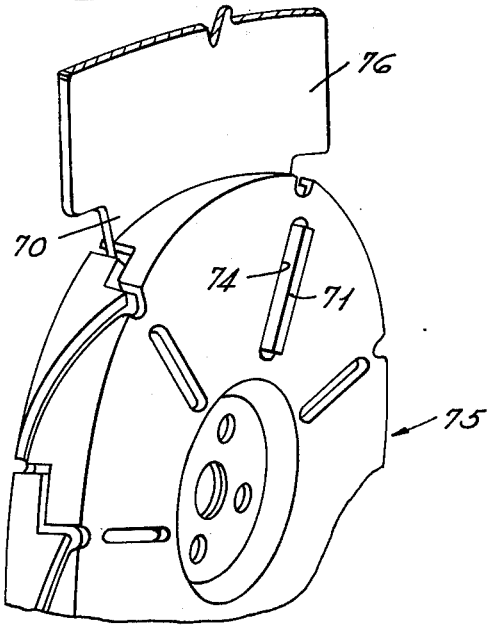
Figure 13:
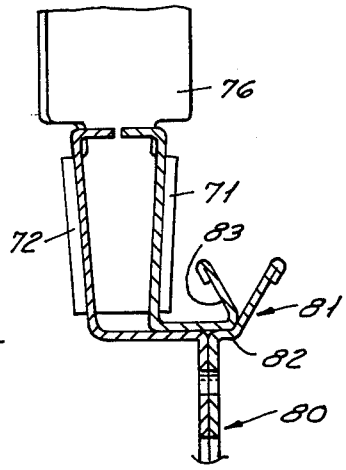
FIG. 13 is yet still another arrangement showing how the hub configuration may be slightly modified.
Figure 11:
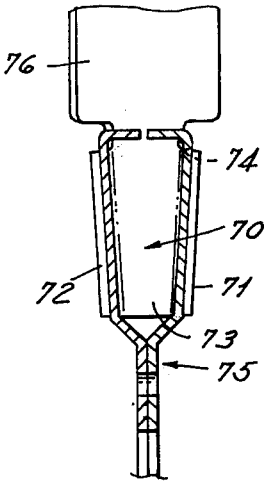

In FIGS. 10–12, the blade 76 has a blade root 70, tabs or flanges 71 and 72 on the respective lever and trailing edges of the web 73. The tabs extend through radially directed slots 74 in the sheet metal hub 75. In FIG. 13, the hub 80 has an offset central section 81 provided with flanges 82 and 83 forming a v groove for a belt drive.

I claim as my invention:

1. A fan blade and root assembly, comprising:

a. a sheet metal blade useful for impelling air, said blade having an axis with leading and trailing edges, said blade having a predetermined curvilinear airfoil contour transverse to the axis of said blade, and b. a blade root having a planar web extending from said blade along said axis and disposed between the leading and trailing edges of said blade, said root having symmetrically arranged wing portions extending from leading and trailing edges of said web and folded back toward the web for substantially completing a hollow polygon spaced from said blade, said polygon having spaced securement walls aligned with the direction said assembly is to be rotated.

2. The assembly of claim 1, in which said blade and root are unitary and are formed from a common ply of sheet metal without the use of independent fasteners.

3. The assembly as in claim 1, in which said web has a transverse width which is at least ⅓ less than the width of said blade, each width measured from the leading to the trailing edge of said respective blade or web, the width of said web most adjacent said blade being equal to or greater than the width of said web most remote from said blade.

4. The assembly as in claim 1, in which the cross-sectional configuration of said polygon is a rectangle, each of said wing portions having a first portion folded at its connection to the web to define an included angle therewith at about 35°–50°, said wings having a second portion folded with respect to the first portion at a included angle of about 90°, the web being disposed as a diagonal between corners of said rectangular configuration.

5. An assembly as in claim 3, in which the polygon of said root assembly is trapezoidal in elevation whereby said assemblies may be arranged in close nesting configuration about an annular hub.

6. A fan assembly, comprising:

a. a multiple number of singly ply sheet metal blades useful for impelling air and having a predetermined curvilinear air foil contour, b. a multiple number of single ply blade roots each integral with one each of said blades and having substantially all portions thereof formed from an individual single unit ply of sheet metal, said root having a planar web extending from said blade along an axis of said blade disposed between the leading and trailing edges of said blade, said root having symmetrically arranged wing portions extending from leading and trailing edges of said web, said wing portions of said root comprising first and second folded portions, the first portion being folded at its connection to the web for defining an included angle therebetween at about 45°, the second portion being folded with respect to said first portion making an included angle therebetween of about 90°, said wing portions forming substantially a polygon in cooperation with said web, c. a hub formed of at least one pair of single ply sheet metal discs each joined at a central zone and separated at a radially outer zone, said outer zone having circumferentially spaced receptacles for receiving each of said blade root assemblies, said hub further having means for securing at least said wing portions of said root assemblies against relative rotary movement therein.

7. The fan assembly as in claim 6, in which said polygon has a general trapezoidal elevational configuration permitting several of said blade and root assemblies to be stationed more closely about said hub.

* * * * *